US008523695B2

(12) United States Patent
Liebl

(10) Patent No.: US 8,523,695 B2
(45) Date of Patent: Sep. 3, 2013

(54) POOL CUE AND METHOD OF MANUFACTURING THEREOF

(75) Inventor: Larry Liebl, Cedarburg, WI (US)

(73) Assignee: McDermott Cue Manufacturing, LLC, Menomonee Falls, WI (US)

( * ) Notice: Subject to any disclaimer, the term of this patent is extended or adjusted under 35 U.S.C. 154(b) by 357 days.

(21) Appl. No.: 13/014,444

(22) Filed: Jan. 26, 2011

(65) Prior Publication Data

US 2012/0190467 A1 Jul. 26, 2012

(51) Int. Cl.
*A63D 15/08* (2006.01)

(52) U.S. Cl.
USPC ..... 473/44

(58) Field of Classification Search
USPC ..... 473/44–48
See application file for complete search history.

(56) References Cited

U.S. PATENT DOCUMENTS

| | | | | |
|---|---|---|---|---|
| 1,521,754 | A * | 1/1925 | Clayton et al. | 473/44 |
| 1,702,292 | A * | 2/1929 | Barrett | 473/44 |
| 2,257,326 | A * | 9/1941 | Blum | 473/44 |
| 4,949,964 | A * | 8/1990 | Jolly | 473/48 |
| 5,334,101 | A | 8/1994 | McDermott | |
| 5,743,803 | A * | 4/1998 | Jordan et al. | 473/48 |
| 5,782,693 | A * | 7/1998 | Jordan et al. | 473/48 |
| 6,783,462 | B1 * | 8/2004 | Costain | 473/44 |
| 2002/0132677 | A1 * | 9/2002 | Chang | 473/44 |
| 2005/0043107 | A1 * | 2/2005 | Kuo | 473/44 |
| 2009/0111596 | A1 * | 4/2009 | Owen et al. | 473/47 |

* cited by examiner

*Primary Examiner* — Mark Graham
(74) *Attorney, Agent, or Firm* — Andrus, Sceales, Starke & Sawall, LLP

(57) ABSTRACT

A pool cue includes a hollow shaft arrangement having a first end and a second end. The shaft arrangement is formed with a bore extending throughout an entire length of the shaft arrangement between the first and second ends. A carrier for mounting the shaft arrangement thereon includes a central section disposed to be received in the bore. The central section has a first end disposed to be engaged against a first end of the shaft arrangement, and a second end provided with a threaded area disposed to extend beyond the second end of the shaft arrangement. The threaded area is connected to other pool cue structure, such as a joint collar or a shaft section, or both, disposed at the second end of the shaft arrangement.

20 Claims, 2 Drawing Sheets

POOL CUE AND METHOD OF MANUFACTURING THEREOF

BACKGROUND OF THE INVENTION

The present disclosure relates generally to jointed pool cues that allow assembly and/or disassembly of one or more sections thereof so as to provide advantages in storage and transportability. In addition, the present disclosure pertains to methods used in constructing and assembling multi-piece pool cues and components thereof in a rapid, cost efficient, self-aligning and precise manner.

DESCRIPTION OF THE PRIOR ART

Referring now to the drawings, FIG. 1 illustrates a prior art jointed, multi-piece pool cue 10 comprising a tapered shaft section 12 coupled by means of a connector 14 to a tapered butt section 16. A pool cue 10 is mainly constructed of a wood such as a hard maple or other suitable hardwood, but may also be constructed of other materials that can be machined. Shaft section 12 has a circular cross section which is largest at a facing edge 18 of connector 14 and gradually decreases at an outermost end provided with a tip portion 20 having a cue tip 22. The butt section 16 has a circular cross section which is smallest at a facing edge 24 of connector 14 and gradually increases to its largest diameter at an outermost end provided with a butt cap and bumper 26.

Referring to FIG. 2, therein is shown the butt section 16 which is typically defined by three main subcomponents, namely, a butt sleeve 28, an underwrap portion 30 and a forearm portion 32, having a circular cross section. The forearm portion 32 is subsequently connected to various smaller components of circular cross section depending on the complexity of the pool cue design. These smaller components may take the form of ornamental rings or sleeve arrangements as are well known to those skilled in pool cue manufacturing and design. The three main subcomponents 28, 30, 32 become a carrier for other components as they are assembled and collectively form the actual finished butt section 16. Two of these main subcomponents, the underwrap portion 30 and the forearm portion 32, require expensive labor operations performed thereon before they can become part of an assembly operation to create a rough built butt segment 16.

More specifically (as depicted in FIG. 3), operations on the underwrap portion 30 include turning outer diameter surfaces 34 with qualities and dimensions critical to running true in a CNC machine (e.g., straightness, rigidity, dimensional uniformity and integrity of material). Particularly, inner diameter holes 36 are drilled and subsequently need to be tapped in opposite ends; additionally, the opposite ends are machined to form tenons 38, 39 that receive the butt sleeve 28 and the forearm portion 32, respectively. Moreover, cutting faces 40, 41 should be uniformly straight where the subassemblies will come together to ensure a high degree of trueness in the finished cue. Similar operations on the forearm portion 32 are performed and typically include turning or machining outer diameter surfaces 42, drilling inner diameter bore 44 and hole 46, which needs to be tapped, and cutting faces 48, 49 uniformly straight. The end of forearm portion 32 at face 49 may further need to be worked to receive a connecting device coupling the forearm portion 32 to the shaft section 12. Once these intensive operations are complete, the underwrap portion 30 and the forearm portion 32 are assembled together using a threaded rod 50 as a reinforcing member, and applying epoxy glue to the tenon 38 insertable into bore 44 and the engaging faces 41, 48. Epoxy glue is also applied to the tenon 39 and face 40 in assembling butt sleeve 28 to the underwrap portion 30.

A problem arises with this method of subassembly in that any area that is not drilled straight or faced correctly causes the butt section assembly to become crooked or misaligned. Such problem then requires disassembly of the subcomponents 28, 30, 32 in an attempt to correct misalignment, such as by shimming the faces 40, 41, 48 which may still cause the cue to be crooked. The fact that the subassemblies are coated with epoxy glue further complicates the issue. With the subcomponents 28, 30, 32 joined together, any voids caused from lack of glue will also create a further problem of noise during play with the cue. Moreover, when the butt section subassembly is completed in its rough stage, additional inlay work is often added. Due to the nature of how the butt assembly is constructed and issues of non-concentricity with the probability of nature changes in humidity (moisture content that causes wood to become warped and deformed), there are added losses when the inlays cannot be correctly cut. To offset this additional problem, the subcomponents 28, 30, 32 must be formed separately where inlays are required adding further time and inefficiency to the cue-forming process.

Therefore, it should be appreciated that previous known cue-making practices have been unreasonably costly and time consuming with a high rework and scrap ratio, requiring expensive CNC equipment and the necessary labor to enable limited production of pool cues.

Accordingly, it is desirable to overcome the drawbacks of prior art pool cue manufacture, particularly in the butt section thereof, and provide a pool cue that can be constructed and assembled quickly, more efficiently and with a higher quality that previously known.

SUMMARY OF THE INVENTION

The present disclosure relates to a pool cue including a hollow shaft arrangement having a first end and a second end, the shaft arrangement being formed with a bore extending throughout an entire length of the shaft arrangement between the first and second ends. A carrier for mounting the shaft arrangement thereon includes a central section disposed to be received in the bore. The central section has a first end disposed to be engaged against the first end of the shaft arrangement, and a second end provided with a threaded area disposed to extend beyond the second end of the shaft arrangement. The threaded area is connected to other pool cue structure disposed at the second end of the shaft arrangement.

The hollow shaft arrangement defines a butt section, and the first end of the carrier defines a butt cap. An inner surface of the bore of the shaft arrangement and an outer surface of the central section of the carrier have circular cross sections. The threaded area of the carrier includes a first threaded segment for receiving a joint collar, and a second threaded segment for receiving a shaft section. The first end of the carrier and the central section of the carrier are cylindrically-shaped with the first end of the carrier having an outer diameter that is enlarged relative to an outer diameter of the central section of the carrier. Likewise, the first threaded segment may have an outer threaded diameter that is larger than an outer threaded diameter of the second threaded segment. The first threaded segment has a length that may be longer than a length of the second threaded segment. The joint collar has an internally threaded bore for receiving the first threaded segment. The second end of the carrier includes an unthreaded tenon extending from the second threaded segment and received in the shaft section. The outer pool cue structure is defined by at least a joint collar and a shaft section.

The present disclosure also contemplates a method for making a pool cue including the steps of (a) supplying a hollow shaft arrangement having a first end, a second end opposite to the first end, and a bore extending throughout an entire length of the shaft arrangement between the first end and the second end; (b) providing a carrier including a central section having a first end and a second end opposite the first end formed with a threaded area thereon; (c) mounting the hollow shaft arrangement on the carrier such that the central section is received in the bore of the shaft arrangement with the first end of the carrier extending outside the shaft arrangement and abutting against the first end thereof, and the second end of the carrier formed with the threaded area extending beyond the second end of the shaft arrangement, and (d) connecting other pool cue structure to the threaded area of the carrier. This method of manufacturing is highly advantageous as the machining operations are significantly reduced and construction of the cue is simplified resulting in production and material cost advantages. Additionally, the method of manufacturing increases the overall quality of the finished pool cue by consistently ensuring enhanced straightness, rigidity, dimensional uniformity and integrity of material, for example, through the elimination of bored tenons in the butt section.

BRIEF DESCRIPTION OF THE DRAWINGS

The best mode of carrying out the invention is described herein below with reference to the following drawing figures.

DETAILED DESCRIPTION

Figure 1:
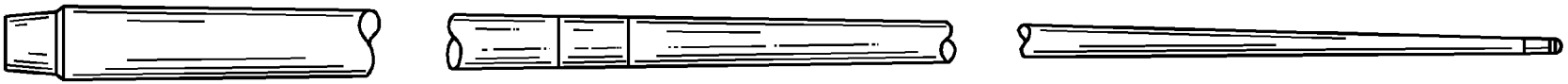
FIG. 1 PRIOR ART
FIG. 1 is a fragmentary elevational view of a prior art pool cue.
Figure 2:
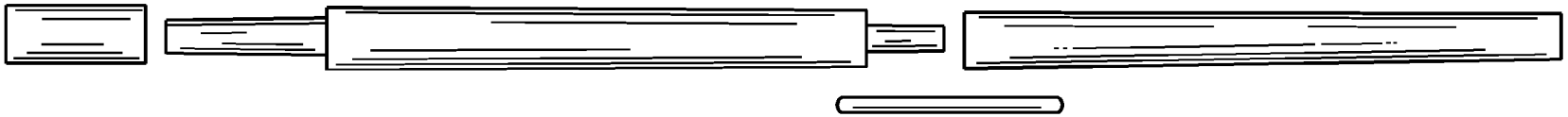
FIG. 2 PRIOR ART
FIG. 2 is an exploded view of various components used in the making of a butt section in the prior art pool cue of FIG. 1.
Figure 3:
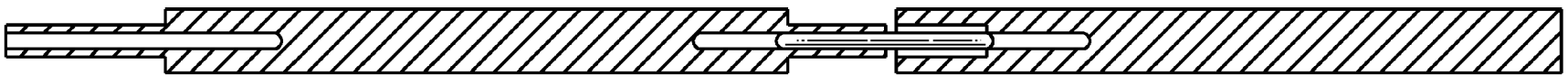
FIG. 3 PRIOR ART
FIG. 3 is a sectional representation of the partial assembly of certain components of the prior art pool cue shown in FIG. 2.
Figure 4:
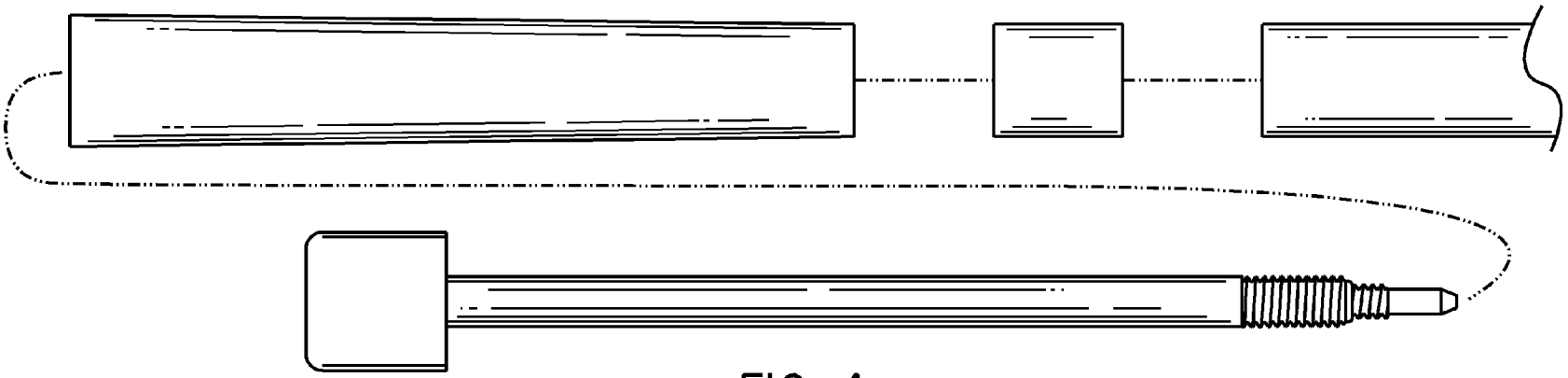
FIG. 4 is an exploded view of the components used in making a pool cue according to the present disclosure.
Figure 5:
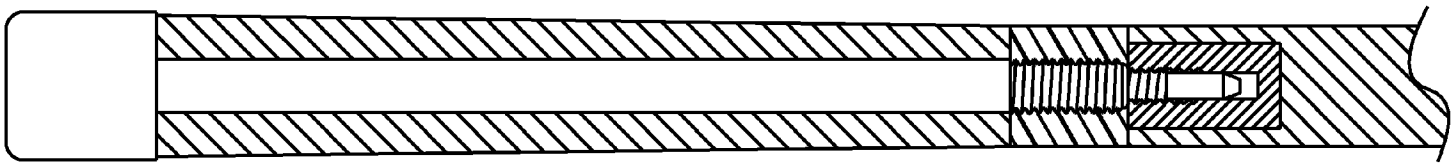
FIG. 5 is a fragmentary sectional view of the assembly of the components shown in FIG. 4.
Figure 6:
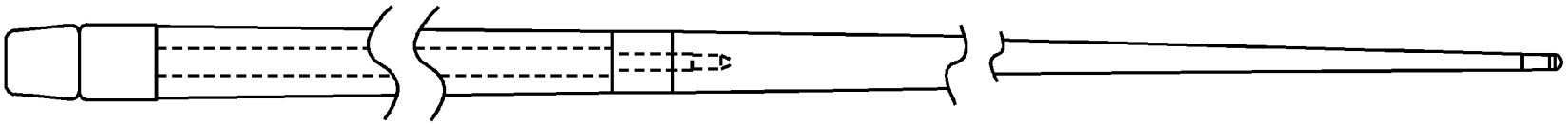
FIG. 6 is a fragmentary elevational view of an assembled pool cue according to the present disclosure.

Referring now to FIGS. 4-6, thereshown is a construction of a pool cue 100 in accordance with the present disclosure. The pool cue 100 is generally comprised of a hollow shaft arrangement 102 (defining a butt section), a carrier 104, a joint collar 106 and a shaft section 108. In the examples shown, the hollow shaft arrangement 102 is preferably fabricated of, but not limited to, a wood material of circular cross section, and is illustrated as a single or one piece, elongated hollow tube or shaft 110 having a first open end 112 and a second open end 114. It should be fully understood, however, that the hollow shaft arrangement 102 may also be embodied as multiple hollow tubes, shafts and collars including rings and sleeves having various lengths and different circular cross sections. The shaft 110 has a circular cross section that may vary along the length thereof, typically decreasing in an outer diameter surface 116 from the first open end 112 to the second open end 114. A smooth bore 118 having a substantially constant circular cross section extends centrally throughout the entire length of shaft 110 as seen in FIGS. 5 and 6.

The carrier 104 is preferably constructed of, but not limited to, aluminum and includes a first end 120 defining a butt cap, an elongated substantially cylindrical central section 122, and a second end 124 that serves as a connector to joint collar 106, shaft section 108 or both. The first end 120 and the central section 122 are cylindrically-shaped with the outer diameter of the first end 120 being enlarged relative to the outer diameter of the central section 122. The second end 124 is formed with a threaded area 126 and an unthreaded tenon 128. The threaded area 126 may include a first threaded segment 130 immediately followed by a second threaded segment 132. In this embodiment, the first threaded segment 130 has a length that is preferably longer than the length of second threaded segment 132. In addition, the threads on first segment 130 preferably have an outer diameter which is larger than the outer diameter of threads on the second segment 132. While it is believed that the dimensional arrangements described above provide the best pool cue, the relative lengths and diameters of the first and second threaded segments may be varied relative to one another. Alternatively, the threaded area 126 may include a single threaded segment connectable to enter a joint collar 106 or a shaft section 108, or both.

The carrier 104 is designed to mount the hollow shaft arrangement 102 thereon such that the central section 122 is received in the bore 118 of shaft 110 with the first end 120 being engaged against the first open end 112 of the shaft 110 and the second 124 extending beyond the second open end 114 of shaft 110 for threaded connection with joint collar 106 and shaft section 108.

Joint collar 106 preferably has a cylindrical outer surface 134 flanked by a first end face 136 and a second end face 138. Joint collar 106 is formed throughout its length with an internally threaded bore 140 which threadably receives the first threaded segment 130 on carrier 104. Shaft section 108 has an inner end formed with a cylindrical chamber 142 for receiving and retaining a mating cylindrical insert 144 having a bore 146 formed longitudinally therein. The wall forming the bore 146 is partially formed with threads 148 and partially formed with a smooth surface 150 extending towards a closed end wall of the insert 144. As seen best in FIG. 5, the end face 136 is snuggly engageable with second end 114 of shaft 110 when joint collar 106 is threaded on the first threaded segment 130 of carrier 104. End face 138 is similarly fitted against an inner end 152 of shaft section 108 when second threaded segment 132 is threadably received in threads 148 of shaft section insert 144, and tenon 128 is received in the remainder of bore 146.

In manufacturing the pool cue 10, one or more solid turned elements of circular cross section are easily provided with the bore 118 using only a conventional drill press to form the hollow shaft arrangement 102 which is slidably mounted upon the carrier 104 as described above. Epoxy glue is conventionally applied between certain surfaces of the carrier 104 and the shaft 110 to maintain a secure arrangement. Other desired pool cue structure, such as defined herein by joint collar 106 and shaft section 108 provided with cue tip 152 thereon, is then screwthreadedly connected to the threaded area of the carrier 104 to form an aligned, assembled pool cue 100 shown in FIG. 6 which includes a bumper 154 joined to the butt cap 120.

It should appreciated that the present disclosure thus provides a method of constructing and assembling a pool cue and particularly the butt section thereof which is faster, more efficient, less costly and free from manufacturing obstacles normally known to those in pool cue production. Specifically, there is no need for separate subassemblies formed by prior art underwrap and forearm portions to be expensively CNC machined at high labor cost with tenons, tapping, facing or turning, and then joined together using a threaded assembly rod or pin. With elimination of the numerous subassemblies, prior art straightening processes are also not required as the carrier 104 maintains the hollow shaft arrangement 102 in alignment and does not permit any non-concentricity issues in crooked butt structures. The carrier 104 is a unitary reinforcing and connecting member that also removes warping issues experienced with wood components in previous subassemblies and minimizes scraps and reworking of pool cues during assembly thereof.

Various alternatives are contemplated as being within the scope of the following claims particularly pointing out and distinctly claiming the subject matter regarded as the invention.

What is claimed is:

1. A pool cue comprising:

a hollow shaft arrangement having a first end and a second end, the shaft arrangement being formed with a bore extending throughout an entire length of the shaft arrangement between the first and second ends; and a unitary carrier for mounting the shaft arrangement thereon including a central section extending through the length of the bore, the central section having a first end disposed to be engaged against the first end of the shaft arrangement, and a second end provided with a threaded area disposed to extend beyond the second end of the shaft arrangement, the threaded area connectable to a shaft section and any additional structure disposed at the second end of the shaft arrangement to form said pool cue.

2. The pool cue of claim 1, wherein the hollow shaft arrangement defines a butt section.

3. The pool cue of claim 1, wherein an inner surface of the bore of the shaft arrangement and an outer surface of the central section of the carrier have circular cross sections.

4. The pool cue of claim 1, wherein the first end of the carrier defines a butt cap.

5. The pool cue of claim 1, wherein the first end of the carrier and the central section of the carrier are cylindrically-shaped, the first end of the carrier having an outer diameter that is enlarged relative to an outer diameter of the central section of the carrier.

6. The pool cue of claim 1, wherein the threaded area of the carrier includes a first threaded segment for receiving a joint collar, and a second threaded segment for receiving a shaft section; and further wherein the carrier extends beyond the first and second ends of the hollow shaft.

7. The pool cue of claim 6, wherein the first threaded segment has a length which is longer than the length of the second threaded segment.

8. The pool cue of claim 6, wherein the first threaded segment has an outer threaded diameter that is larger than an outer threaded diameter of the second threaded segment.

9. The pool cue of claim 6, wherein the joint collar has an internally threaded bore for receiving the first threaded segment.

10. The pool cue of claim 6, wherein the second end of the carrier includes an unthreaded tenon extending from the second threaded segment and received in the shaft section.

11. The pool cue of claim 1, wherein the additional structure includes a shaft section, or both a joint collar and shaft section.

12. A method for making a pool cue comprising the steps of (a) supplying a hollow shaft arrangement having a first end, a second end opposite the first end, and a bore extending throughout the entire length of the shaft arrangement between the first end and the second end;

(b) providing a unitary carrier including a cental section having a first end and a second end opposite the first end formed with a threaded area thereon;

(c) mounting the hollow shaft arrangement on the carrier such that the central section extends through the length of the bore of the shaft arrangement with the first end of the carrier extending outside the shaft arrangement and abutting against the first end thereof, and the second end of the carrier formed with the threaded area extending beyond the second end of the shaft arrangement; and (d) connecting additional pool cue structure the threaded area of the carrier.

13. The method of claim 12, wherein the hollow shaft arrangement defines a butt section.

14. The method of claim 12, wherein the bore of the shaft arrangement and the central section of the carrier have circular cross sections.

15. The method of claim 12, wherein the first end of the carrier and the central section of the carrier are cylindrically shaped, the first end having an outer diameter that is enlarged relative to an outer diameter of the central section of the carrier.

16. The method of claim 12, wherein the threaded area of the carrier has a first threaded segment for receiving a joint collar, and a second threaded segment for receiving a shaft section; and further wherein the carrier extends throughout the entire length of the hollow shaft and the collar.

17. The method of claim 16, wherein the second end of the carrier includes an unthreaded tenon received in the shaft section.

18. The method of claim 16, wherein the first threaded segment has an outer threaded diameter that is larger than an outer threaded diameter of the second threaded segment.

19. The method of claim 16, wherein the joint collar has an internally threaded bore for receiving the first threaded segment.

20. The method of claim 12, wherein the additional pool cue structure includes a shaft section, a joint collar or a combination thereof threadably attached to the threaded area of the carrier.

* * * * *